US008608675B2

(12) United States Patent
Cardile

(10) Patent No.: US 8,608,675 B2
(45) Date of Patent: Dec. 17, 2013

(54) APPARATUS FOR REHABILITATION OF PATIENTS SUFFERING MOTOR DYSFUNCTION

(76) Inventor: Jorge Cardile, Florida (AR)

( * ) Notice: Subject to any disclaimer, the term of this patent is extended or adjusted under 35 U.S.C. 154(b) by 891 days.

(21) Appl. No.: 12/722,458

(22) Filed: Mar. 11, 2010

(65) Prior Publication Data

US 2010/0248903 A1 Sep. 30, 2010

(30) Foreign Application Priority Data

Mar. 25, 2009 (AR) ..... 20090101047

(51) Int. Cl.
*A61H 1/00* (2006.01)
*A63B 22/00* (2006.01)

(52) U.S. Cl.
USPC ..... 601/29; 601/35; 482/51

(58) Field of Classification Search
USPC ..... 601/5, 23, 24, 26, 27, 29, 31, 32, 33, 601/34, 35, 84, 97, 98, 101, 103, 104; 482/51, 52, 54, 69, 70, 71
See application file for complete search history.

(56) References Cited

U.S. PATENT DOCUMENTS

| | | | | |
|---|---|---|---|---|
| 3,824,994 | A * | 7/1974 | Soderberg, Sr. | 601/29 |
| 4,862,875 | A * | 9/1989 | Heaton | 601/26 |
| 5,941,800 | A * | 8/1999 | Laconis | 601/23 |
| 6,666,798 | B2 | 12/2003 | Borsheim | |
| 6,689,075 | B2 * | 2/2004 | West | 601/23 |
| 2007/0179411 | A1 * | 8/2007 | Galvez Campos | 601/29 |

* cited by examiner

*Primary Examiner* — Quang D Thanh
(74) *Attorney, Agent, or Firm* — Novak Druce Connolly Bove + Quigg LLP

(57) ABSTRACT

An apparatus for rehabilitation of patients with motor disorders affecting the legs and standing dysfunctions, the apparatus comprising a couple of bars moving along a closed loop representing a walking step for the patient, with each bar including a plate to affix a foot of the patient and the plate being slidably arranged in the bar, with a motor connected to the bars to move the bars along the closed loop, the apparatus also having an harness to support the patient.

20 Claims, 16 Drawing Sheets

APPARATUS FOR REHABILITATION OF PATIENTS SUFFERING MOTOR DYSFUNCTION

BACKGROUND OF THE INVENTION

1. Field of the Invention

The present invention relates to a new device that may be employed in the medical, physical training and/or rehabilitation field and, more particularly, the invention refers to a new apparatus for rehabilitation and/or re-education of an impaired patient, preferably an individual or patient with dysfunction in the lower limbs, to induce walking movements, develop balance and train muscles, preferably in handicapped persons with gross motor impairments, wherein the apparatus is effective in helping correct the postural (stance) structure and also attaining the exact reproduction of human walking, efficiently inducing the movement of the joints of the foot, heel, ankle, knee and hips, all of them with high participation in the walking movements.

2. Description of the Prior Art

For several reasons, an important part of a community is affected by motor disorders or dysfunctions, due to accidental events or to neurological disorders. In any event, in modern communities more and more efforts are being made to incorporate disabled persons to the normal life of the community. The idea is to adopt more effective techniques in order that they may enjoy, depending on the degree of the disability, the autonomy to move among the other members of the community. It is a fact that the degree of dependence affects directly the standard of living of these citizens and, therefore, it is imperative to be socially sensitive to bring to the disabled persons the most modern solutions to cause them to be capable of joining, as long as possible, the normal persons.

The disabilities that affect the lower limbs basically hinder or limit displacement and the two-legged stance. On top of the difficulty or impossibility of walking, there is the loss of reflexes and muscle tone due to inactivity or reduced functionality, the slowdown of systemic functions such as circulation, the contraction of the abdominal cavity that hampers the respiratory and digestive functions and the proper evacuation of the bowels, progressive scoliosis, bone density loss, as well as diverse dermatological pathologies, all effects that aggravate even more the condition and quality of life of the patient.

The technical solutions available to persons with motor dysfunctions, for walking rehabilitation purposes, can be generally classified in mobile and fixed devices that have been aimed at helping patients recover their walking capabilities, without, however, efficiently achieving the right motor coordination, balance control of the limbs and torso, correction of the body posture and strengthening of the atrophic limbs. In general terms, the known mobile equipment uses the patient's own force to move, using devices commonly known as walkers.

One of such mobile devices is disclosed in Document WO 2008058534, to Sorensen Nicolai and Balle Rune, entitled "Walking device for assisting handicapped persons or patients during rehabilitation". Other apparatus of this type are disclosed in DE 10318929 to Graf Birgit, entitled "Motorised walking aid for assisting disabled person with integrated data detection device for detecting movement data during use of walking aid", EP 0713692 to Paas Dieter, entitled "Walking training device for disabled people".

While the above devices may be helpful in assisting a handicapped person to walk and stimulate walking movements, the systems are based mainly on the force that the patient must exert with the upper limbs on the device that serves as a support to maintain the two-legged stance. The devices are a kind of a support or cart moving over some sort of rollers or wheels and the patient must exert the necessary force against the floor to move. It is obvious that the patient must be capable of standing up and walk, at least slightly and this is not possible for patients having strong neurological disorders with practically no muscles in conditions to support the body weight or to move the legs to get a minimal walking distance. In addition, the above systems do not provide any type of step regulation or limb movement sequence. But what is an additional limiting factor in this type of equipment is that not a single one of them provides for correction of the walking gait; they do not develop adequate motor coordination, and they do not allow for adopting the correct postural stance needed for human beings to take steps in the correct sequence to achieve full rehabilitation.

Other devices are disclosed in RU 2306129 to Aliev Gazi Aligadzhievich et al. entitled "Rehabilitation Assembly Provided With Arm and Leg Trainers"; DE 102005051674 to Miehlich Dieter, entitled "Pulling apparatus for use in e.g. rehabilitation device, for muscle exercise ( . . . ) to arms or legs, where power is transmitted to output of motor", and DE 10258755 to of Haas Siegliende, Bayersdorfer Valentin and Hass Hannes, entitled "Walking exercise simulator with shallow inverted V-profile supported each side by springs and motion dampeners". These devices provide the patient with the means to strengthen, exercise and avoid numbness, loss of reflexes and mobility of some of the joints, with which a limited rehabilitation is attained. However, while a movement may be promoted, not all the foot, leg and hip articulations are involved and no achievement of postural fitness, motion balance and good alignment of limbs and torso, which is to be desired of any rehabilitation process are provided.

In addition to the foregoing, DE 102005014204 to Steinert Chistoph, entitled "Old person's natural heading movement stimulator produces movement of lower extremity/limb in frequency and with dynamics of walking, where movements of ankle joint is effected in frequency of heading movement", and FR 2691127 to of Michel Sarciron, entitled "Medical re-training aid to assist patient in controlling feet", disclose devices to primarily stimulate joints and, in particular, ankles.

U.S. Pat. No. 6,666,798 to Borsheim, discloses an apparatus for rehabilitation of a functionally impaired leg of a patient suffering from paralysis, adapted for receiving also an attendant, both, patient and attendant exercising on a treadmill, with the apparatus comprising leg brackets adjacent to the patient's and attendant's knees, a connecting member coupling the leg brackets to transmit motion from an attendant's leg to a patient's leg. The apparatus also including an ankle appliance having an upper extension and a lower extension proximate the ankle is attached to a patient's foot and an ankle brace is similarly attached to an attendant's foot. Thus, the coordinated leg and ankle movement allows a patient's paralysis damaged leg to duplicate the walking motion of an attendant's leg. The apparatus also uses handrails in the treadmill and a suspension strap to keep the patient in a suspended position to allow leg movement without the hindrance of up to full body weight. This apparatus does not teach neither suggests the possibility of varying the height of the strap to permit the body weight of the patient to be transmitted to the legs to better train the lower limbs supporting at least part of the natural body weight. In addition, the belt of the treadmill runs always in the same direction without guiding the patient's feet to emulate the entire walking movement, namely along a closed loop.

As it can be seen, the state of the art and existing technologies do not offer those individuals suffering from severe motor dysfunctions an integral solution for their rehabilitation, obtaining only partial results. There is no fixed or mobile device that enables these people to rehabilitate, achieve postural fitness, motion balance and good alignment of limbs and torso, with the advantage of strengthening and working out the muscle system, tendons and circulatory system, as well as all the joints involved in the walking activity, supporting the patient's body weight in an adjustable pattern, all in a single device.

SUMMARY OF THE INVENTION

It is therefore an object of the invention to provide an apparatus for rehabilitation of patients with motor disorders, wherein the apparatus comprises an harness for supporting the patient and a couple of walking bars to which the feet of the patients are affixed to, and wherein the device helps rehabilitate the lower limbs of people with severe motor disorders, making it possible to increase muscle tone and helping the individual to develop balance, whereby patients suffering from central nervous system disorders manage to improve their muscular activity and to normalize their muscle tension.

It is still another object of the present invention to provide an apparatus for rehabilitation of patients with motor disorders, wherein the apparatus comprises a harness for supporting the patient, with the patient having their feet affixed to a couple of walking bars to really reproduce the movements of the lower limbs when walking, step by step at a constant pace, stimulating the nervous system with a mechanical movement generated from the lower limbs themselves, wherein, by systematically and repeatedly practising the exercise produced by the device, the patient, by reflex and voluntary activation, executes the movements necessary to help him/her walk and/or rehabilitate thanks to the recovery of the normal tone of his/her muscles.

It is even another object of the present invention to provide an apparatus for rehabilitation of patients with motor disorders, wherein the apparatus comprises a harness for supporting the patient, with the patient having their feet affixed to a couple of walking bars to really reproduce the movements of the lower limbs when walking, with the harness being pending from an upper part of the apparatus including height regulating means for moving the harness up and down to have the patient's body weight unloaded on the legs reduced or increased for better training of the legs.

It is a further object of the present invention to provide an apparatus for rehabilitation of patients with motor disorders affecting the legs, the apparatus comprising a couple of bars moving along a closed loop representing a walking step for the patient, with each bar including a plate to affix a foot of the patient and the plate being slidably arranged in the bar, with a motor connected to the bars to move the bars along the closed loop, the apparatus also having an harness to support the patient.

It is even a further object of the present invention to provide an apparatus for rehabilitation of patients with motor disorders, particularly patients suffering motor dysfunction in the legs, the apparatus comprising:

a left and right walking bars moving up and down and fore and aft along a closed movement loop;

a left and a right foot retaining means pivotally connected to the left and right walking bars respectively, for moving with the walking bars along a step distance path, and a patient's supporting means for supporting the patient.

It is still a further object of the present invention to provide an apparatus for rehabilitation of patients with motor disorders, particularly patients suffering motor dysfunction in the legs, the apparatus comprising:

a left and right walking bars moving up and down and fore and aft along a closed movement loop;

a left and a right foot plate pivotally connected to the left and right walking bars respectively, for moving with the walking bars along a step distance path;

fastening means in the left and right plates for retaining the feet of a patient during a treatment;

a front guide stop at a front end of the step distance path and a rear guide stop a rear end of the step distance path, to cause the foot plates move up and down in the ends of the step distance path, and a supporting harness for supporting the patient.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
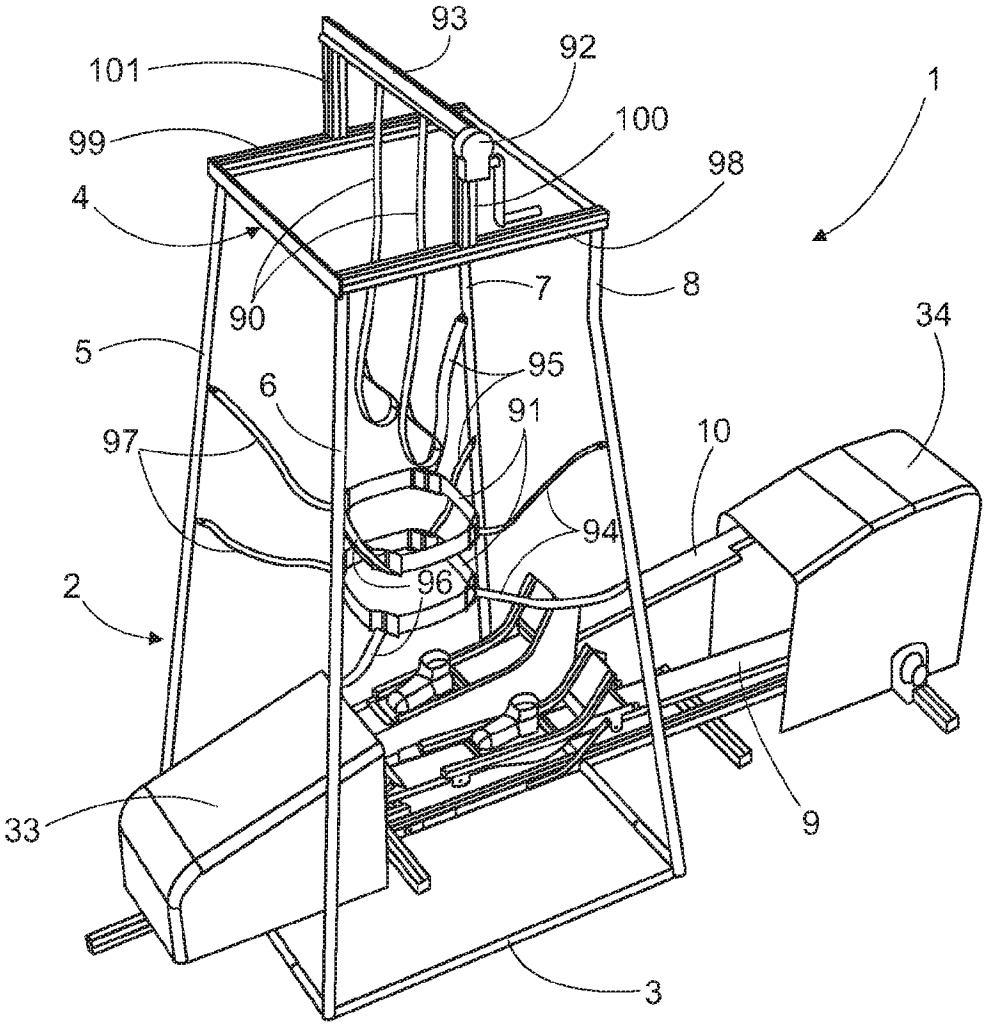
FIG. 1 is a perspective top view of the apparatus according to an embodiment of the present invention.
Figure 2:
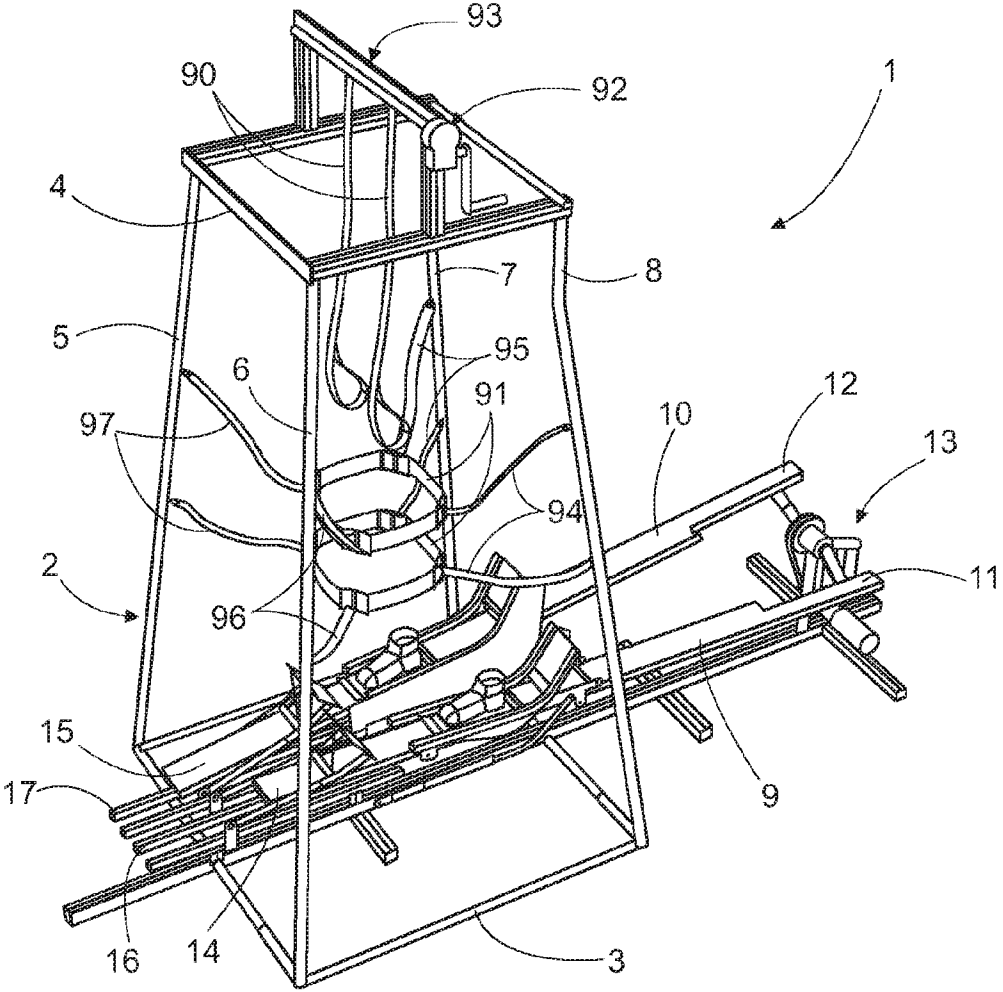
FIG. 2 is a perspective top view of the apparatus of Figure one with some end front and rear caps removed for clarity purposes.

Now referring in detail to the invention, the same refers to an apparatus for use preferably in medical areas to rehabilitate patients with motor disorders, particularly patients suffering motor dysfunction in the lower limbs. However, while more specific reference will be made to rehabilitation of the lower limbs, the present apparatus has shown to be effective in a re-educating and rehabilitating a handicapped person integrally, such as correcting postural disorders, neuronal disorders, standing disorders and other physical dysfunctions. The apparatus, generally indicated by reference number 1 in FIGS. 1 and 2, comprises a support structure such as a chassis 2 of a light and resistant construction and material, of aluminium or steel for example, having a base 3, a top or upper portion 4 and a plurality of columns 5, 6, 7, 8. The chassis is resistant and capable of supporting at least the weight of a patient and the components.

Mounted at a bottom part of the chassis, a left 9 and right 10 walking bars are provided, with the bars being mounted to move along a path emulating, duplicating or copying the natural walking movement, such as up and down and back and forth along a closed movement loop, such as a seesaw movement, for example. Bars 9, 10 may be made of any suitable material such as steel or aluminium and preferably of a hollow metal profile to be resistant and of a light weight to support the patient's weight. The weight of the patient will be controllably unloaded, partially or totally, on the bars.

Figure 3:
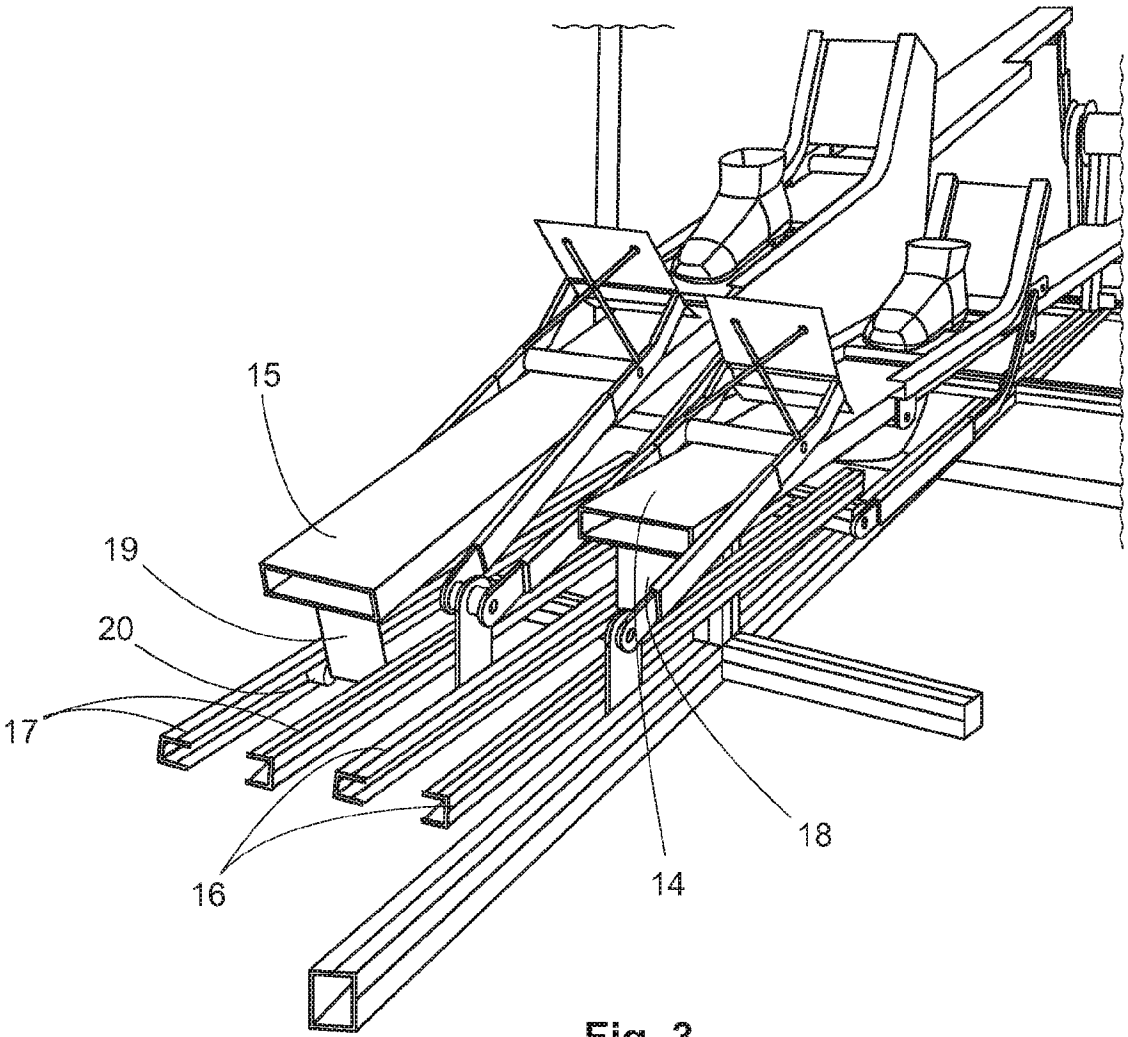
FIG. 3 is a detailed perspective view taken from the front end of the apparatus to show how the walking bars are slidably mounted in the front guide means.

To move along a desired predetermined path, such as a closed loop, copying a walking step movement, each walking bar 9, 10, has a respective rear end 11, 12 connected to motor means 13 and a respective front end 14, slidably connected to respective front guide means 16, 17. The sliding connection between front ends 14, 15 of walking bars 9, 10 are preferably established by a bracket 18, 19 having, at a lower edge thereof, a rotary shaft (not shown) with end rollers of which only one roller 20 is shown in bracket 19, and only one roller 21 is shown in bracket 18, see FIGS. 3 and 6. While not shown, the rotary shafts in brackets 18, 19, are provided with rollers opposite and associated to rollers 20, 21 to properly slide along front guide means 16, 17. In effect, rollers 20, 21 run along front guide means 16, 17, with each guide comprising a "C" profile member, as shown in FIG. 3, firmly affixed to a front end of the chassis. Guides 16 and are respectively facing to each other by their open sides to slidably receive the end rollers 20 with its opposite roller (not shown), and roller 21 with its opposite roller (not shown), of each bracket 18, 19.

In addition to the movement in a longitudinal direction of the bars along guides 16, 17, the rear ends 11, 12 of the walking bars move along a circular path or closed loop, not necessarily circular as long as it copies the walking movement, under the action of said motor means 13. Motor means 13 preferably comprise a crank and connecting rod mechanism driven by an electric motor 22, or a motor and speed reducing gearbox, mounted in a base member 23, forming part of the chassis. Motor 22 actuates a pulley 24, a belt 25 and a pulley 26 which in turn moves a crank connecting rod comprising a couple of rods 27, 28 which are preferably extensible and regulated through a regulating assembly formed by orifices 29 and knob 30, as it is well known. Connecting rods 27, 28 are connected to ends 11, 12 of the walking bars by respective journalled or bearing connection with only one of them, namely connection 31, being shown. The length of connecting rods 27, 28 defines the walking step distance or path, which would be regulated according to the kind of dysfunction, age and size of the patient, by means of the regulating means 29, 30. The height of pulley 26 may be also regulated by extensible arms 32 with regulating means that can be like means 29, 30.

While ends 11, 12 are shown as cut and made of a hollow rectangular metal profile, the ends and the entire walking bars may be made of solid bars, and other design, with no cuts, is possible. While a crank-connecting-rod mechanism has been shown to provide a circular or looped movement, it will be apparent to any person skilled in the art that other mechanisms may be employed. For example, this mechanism may be replaced by a couple of gears, a leading gear and a rear gear, and at least one chain running around them, along an elliptical or ovoid path, with ends 11, 12 of bars 9, 10 being connected to both sides of the chain, to particular links of the chain, by respective journalled connection, in order to follow the elliptical loop of the chain. The closed path defined by the chain will be as close as possible like a walking movement.

The front guide assemblies 16, 17, at the front end of the apparatus, and motor means 13, at a rear end of the apparatus, are properly covered by respective front 33 and rear 34 caps fixed at appropriate parts of the chassis, preferably by means of easily removable means to permit access to the corresponding mechanisms for servicing purposes. Caps 33, 34 may be made of any suitable material to protect the covered mechanisms, such as a plastic, resistant and light material.

The patient will step on the walking bars in a left 35 and a right 36 foot retaining means pivotally connected to left 9 and right 10 walking bars respectively. As it will be explained below, foot retaining means 35, 36 move together with the walking bars along the closed loop or step distance path, to copy the movement of a walking step. Left 35 and right 36 foot retaining means comprise a left 37 and a right 38 foot plate assemblies pivotally connected to left 9 and right 10 walking bars respectively. As it is better shown in FIGS. 9-13, each foot plate assembly 37, 38 is comprised of two foot plates pivotally connected to each other, namely an upper foot plate 39, for receiving the left food of the patient, and upper foot plate 40 for receiving the right foot of the patient, as well as a lower foot plate 44, in the left side, see FIGS. 9, 10, and a lower foot plate 45, in the right side, see FIGS. 11, 12. Each foot of the patient must be firmly affixed to each foot plate 39, 40 and, for that purpose, a left boot 41 and a right boot 42 may be provided in the foot plates 39, 40 to receive the feet of the patient comfortably. Alternatively, the patient's feet with their own shoes, may be retained in the foot plates 39, 40 by other fastening means. In this case, for illustrative purposes, boots 41, 42 may represent the feet of the patient and the fastening means may comprise respective ribbons 43 affixed at the foot plates for embracing the feet of the patient and retaining the feet in the foot plates. Ribbons 43 may be provided, as it is well known, with any adherence means such as hook-and-loop retaining means. Ribbons 43 have been shown only in one foot 42 in FIG. 5, for clarity purposes, but it is evident that the same will be provided in both feet.

Figure 9:
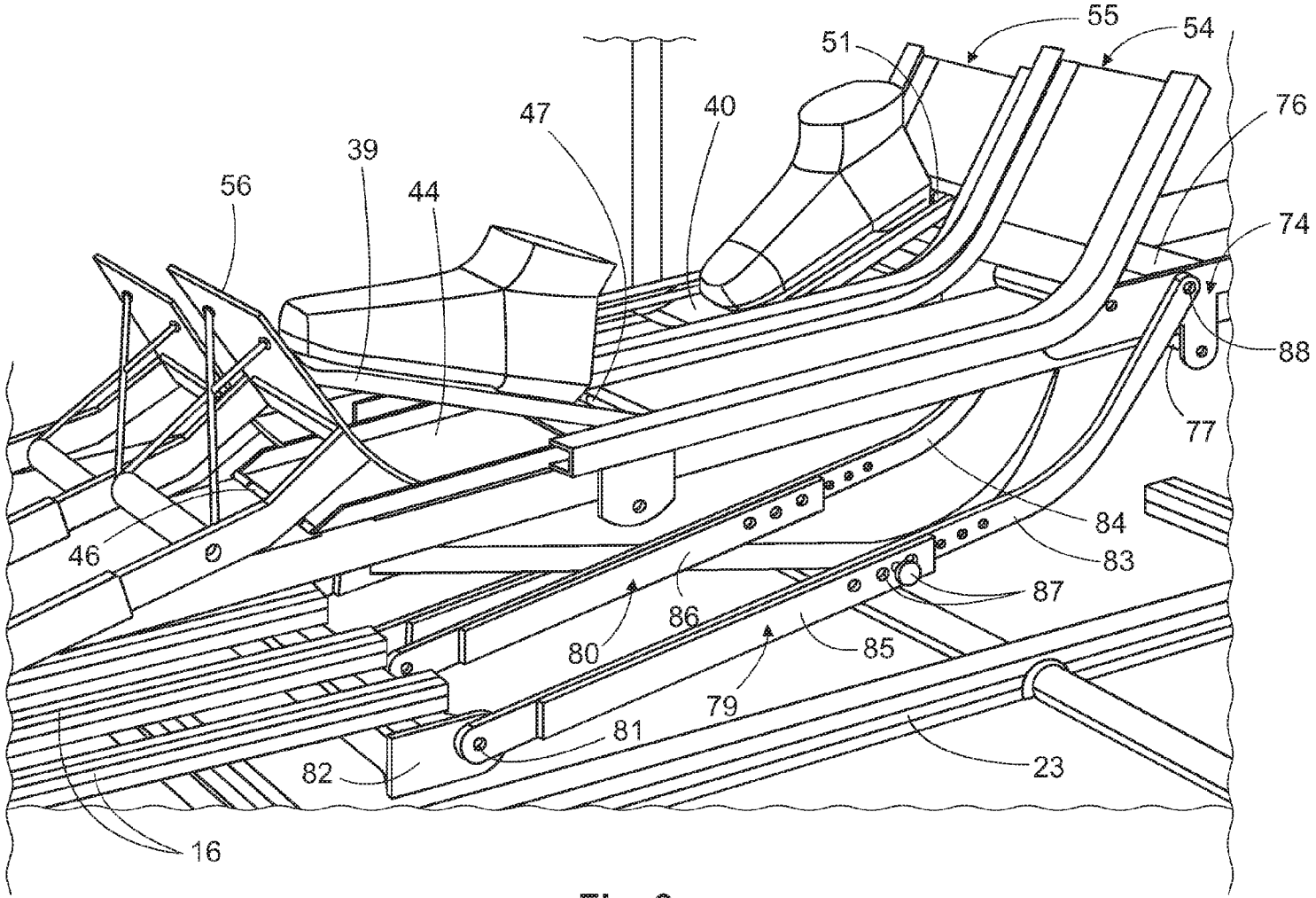
FIG. 9 is a detailed side perspective view of the apparatus, similar to FIG. 5, showing the schematic feet of a patient during another sequence in the movement of the feet.
Figure 10:
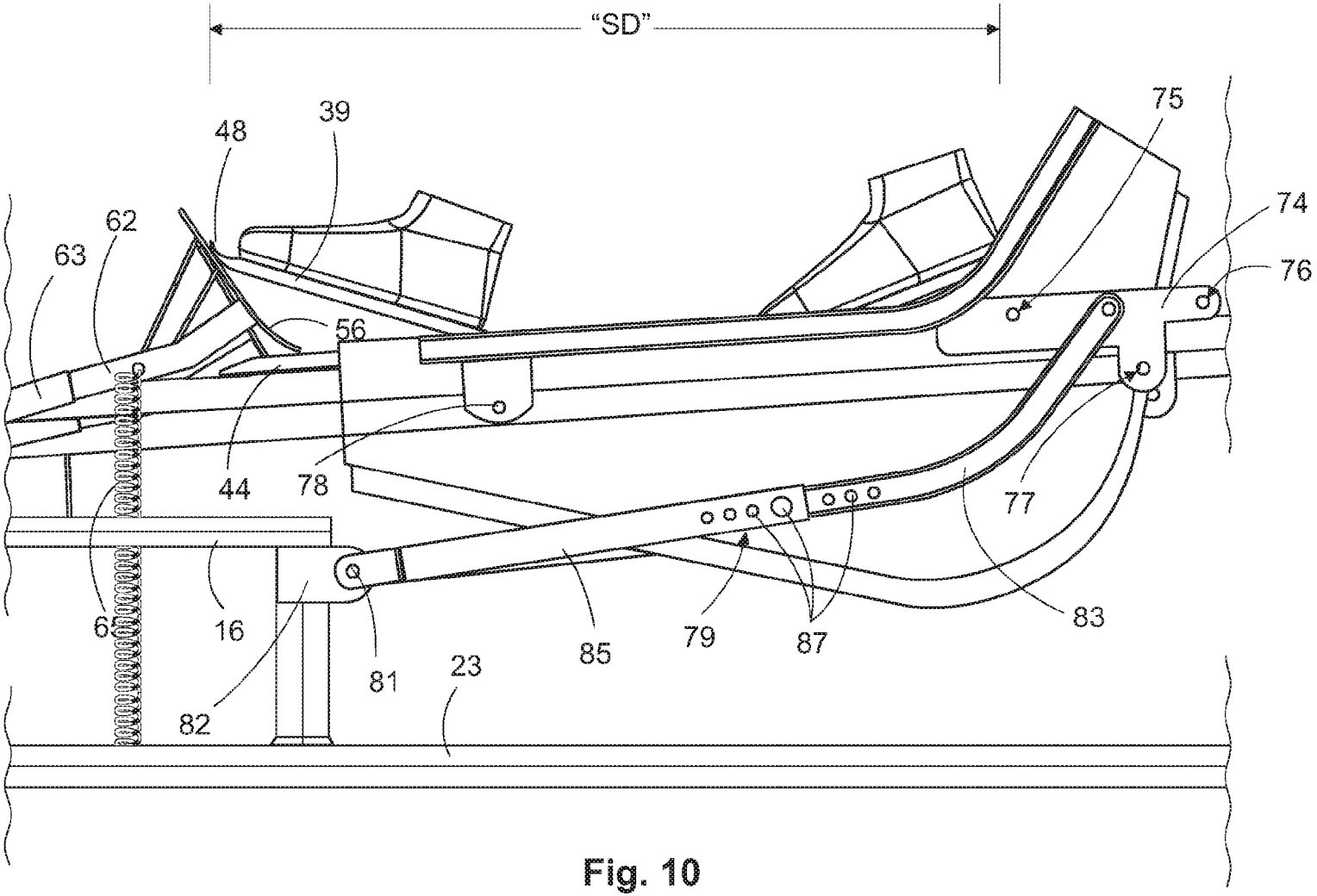
FIG. 10 is a detailed side elevation view of the apparatus, showing the schematic feet of a patient during the sequence in the movement of the feet showing in FIG. 9.
Figure 11:
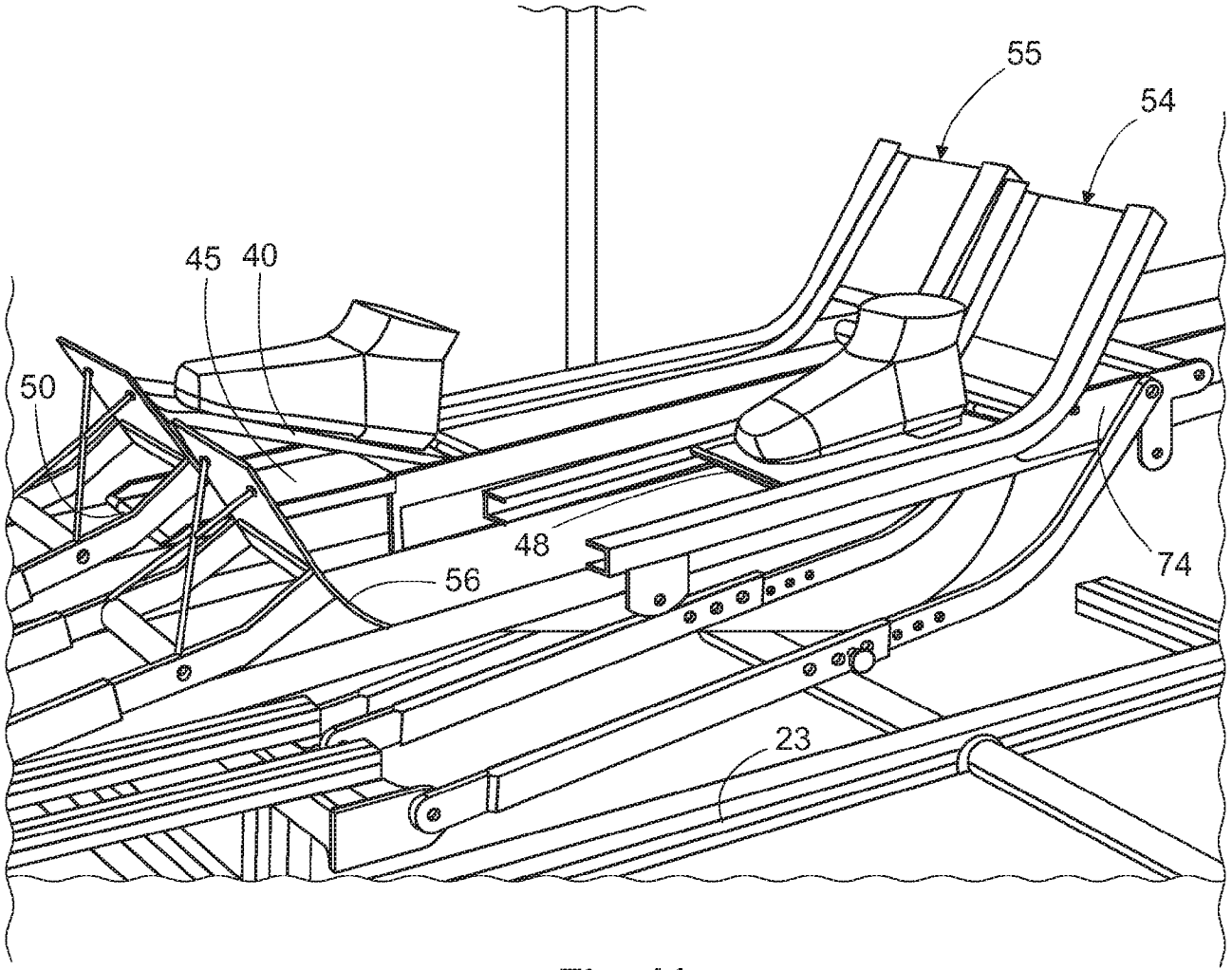
FIG. 11 is a detailed side perspective view of the apparatus, similar to FIG. 5, showing the schematic feet of a patient during another sequence in the movement of the feet.
Figure 12:
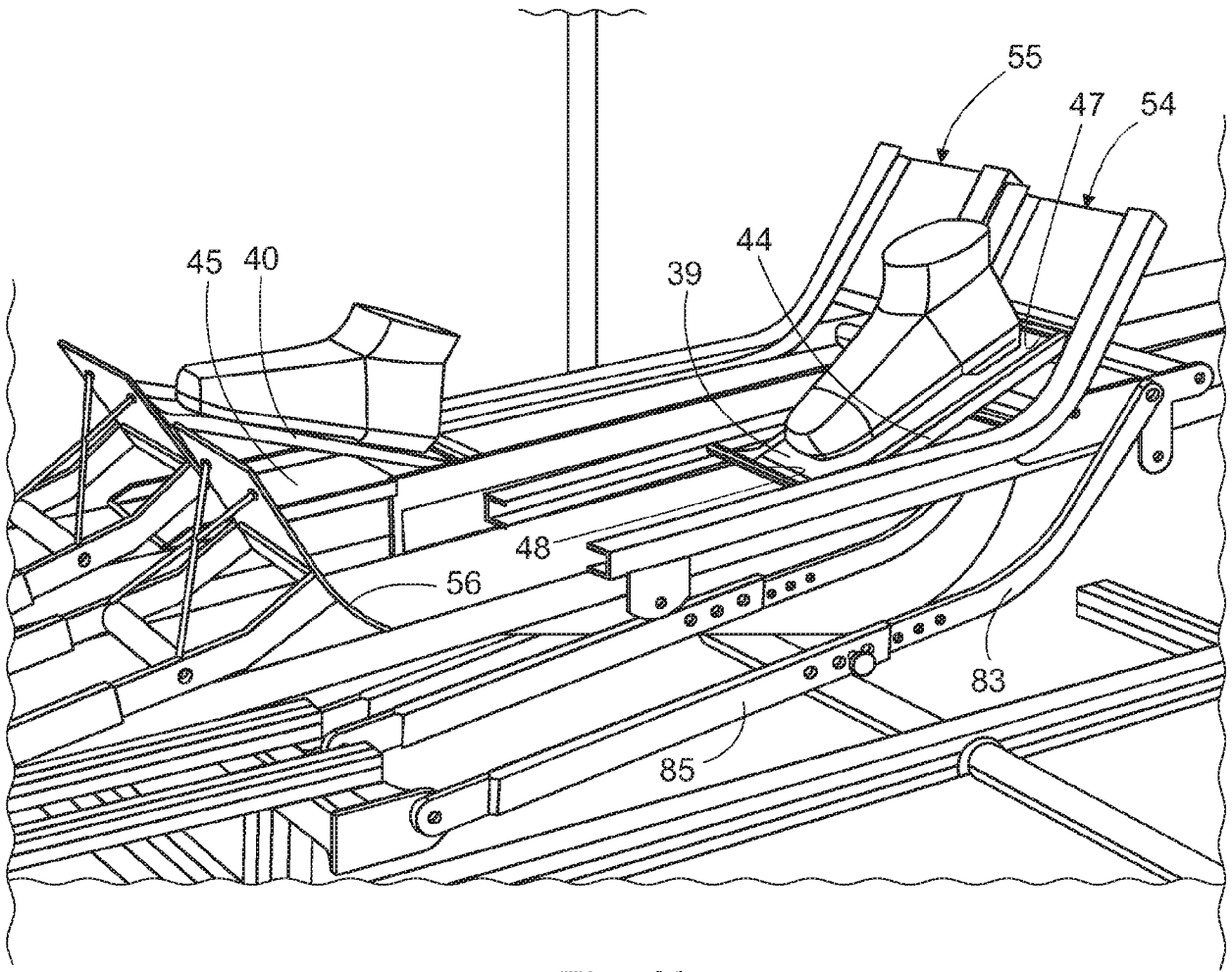
FIG. 12 is a detailed side perspective view of the apparatus, similar to FIG. 11, showing the schematic feet of a patient during another sequence in the movement of the feet.
Figure 13:
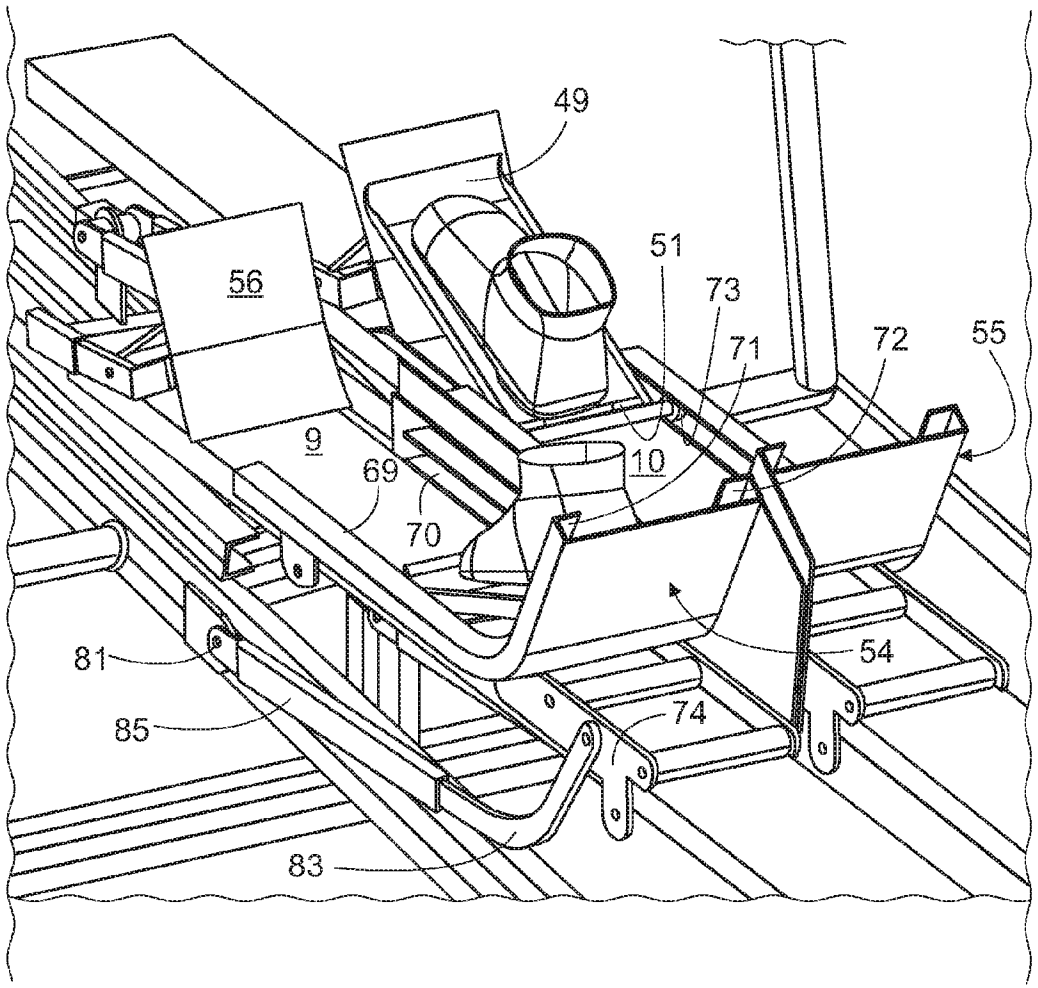
FIG. 13 is a detailed rear perspective view of the apparatus, showing the schematic feet of a patient during the sequence in the movement of the feet showing in FIG. 12.

Upper foot plates 39, 40 and lower foot plates 44, 45, as mentioned above, are pivotally connected to each other and to the respective walking bar 9, 10 by double hinged means. Reference will be made first to left foot plate 35 as long as right foot plate 36 is similarly constructed. Left lower foot plate 44 has a front edge hinged, by a hinge 46, see FIG. 9, to walking bar 9, thus being capable of pivoting at 46 and moving to a position as shown in FIGS. 12, 13. In addition, lower plate 44 has a rear edge hinged, by a hinge 47, see FIGS. 7, 8, 12, 13, to a rear edge of upper plate 39, forming a rear hinged connection, to be capable of pivotally moving around hinge 47 to have a position as shown in FIGS. 9, 10. As indicated before, right foot plates 40 45 are pivotally connected in like manner by a leading hinge 50, see FIG. 11, and a rear hinge 51, see FIG. 13. Upper plates 39, 40 have respective leading edges that are curved as shown by 48, 49 to be guided and slidably move along and onto front guide stops 52, 53 as detailed disclosed below.

While foot plates 39, 44 and 40, 45 have been disclosed as being connected to each other and to the walking bars by means of a double-hinge mechanism, it will be apparent to any skilled person in the art that any other tilting or oscillating mechanism may be adopted. For example, upper plates 39, 40 may be mounted in respective central transverse axis, placed at a distance above the walking bars, or onto a semicircular block onto the walking bars, to force the patient to keep the feet as horizontal as possible at least until the plate is tilted under the action of the guide stops reference to which is made below.

Front and rear guide stops are provided in the chassis and associated to the walking bars to force the foot plates to tilt according to the walking movement. Thus, the apparatus is provided with front guide stop 52 for the left foot and front guide stop 53 for the right foot, in each walking bar. Guide stops 52, 53 are adjustably placed at a front end of step distance path "SD", see FIG. 10. In addition, a rear guide stop 54 for the left foot and rear guide stop 55 for the right foot, in each walking bar, are adjustably placed at a rear end of step distance path "SD". Guide stops 52-55 will cause foot plates 39, 40, 44, 45 move up and down when reaching the ends of the step distance path in order to copy as close as possible the natural walking movements. Thus, the foot will be forced to move in the articulations or joints of the heel and the ankle.

For clarity purposes only front guide stop 52 for the left foot will be described in detail as long as the front guide stop for the right side is identical. Front guide stop 52 comprises a curved front guide stop plate 56, made of any resistant material, such as steel or any other suitable metal. Plate 56 is firmly affixed to respective rear ends of a couple of extensible arms 57, 58 which have their leading ends pivotally connected at 59, 60, to any convenient part of the chassis, by any appropriate bearing means well know in the art. Arms 57, 58 may include adjusting means to regulate the length of the arms in order to move plate 56 back and forth to a desired position to adjust the step distance according to the particular treatment or patient. Adjusting means indicated by reference 61 may be a well known mechanism of a plurality of orifices and knob to move and fix a relative position between two arm lengths 62, 63.

Figure 5:
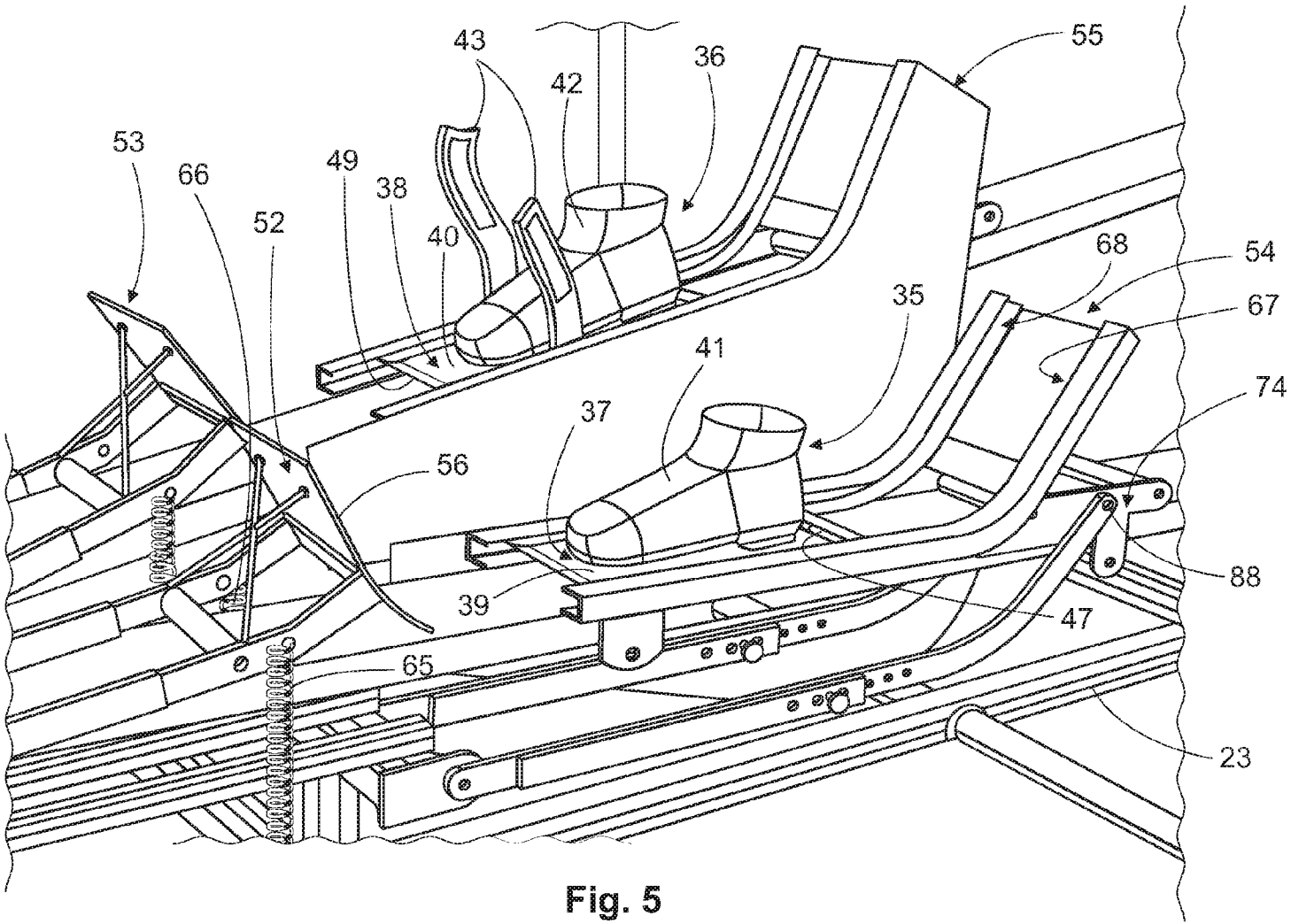
FIG. 5 is a detailed side perspective view of the foot plates pivotally connected to the walking bars and the front and rear guide stops, with a couple of schematic feet representing the feet of a patient, during a sequence in the movement of the feet.
Figure 6:
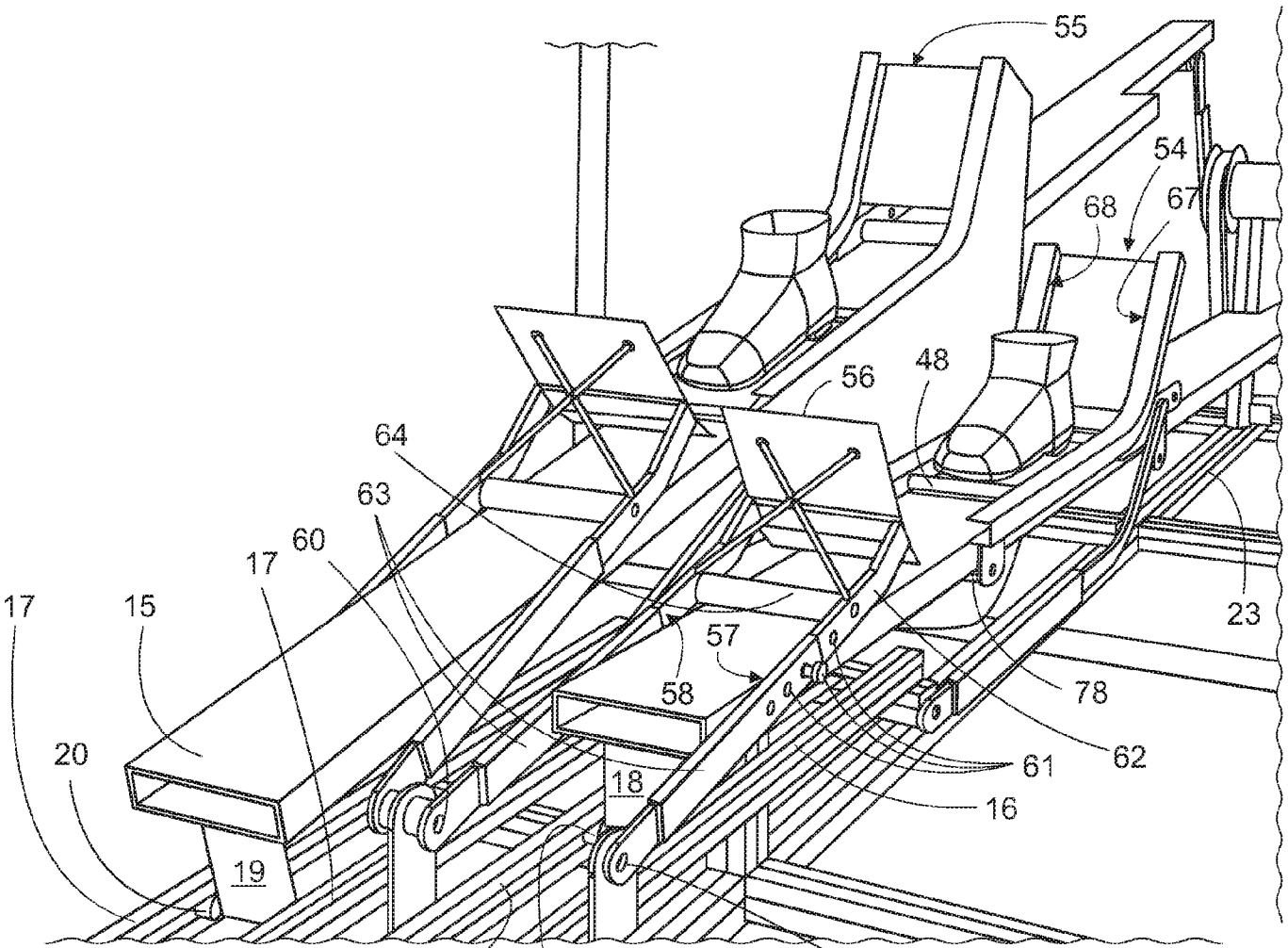
FIG. 6 is a detailed front perspective view of the apparatus, similar to FIG. 5, showing the schematic feet of a patient during another sequence in the movement of the feet.
Figure 7:
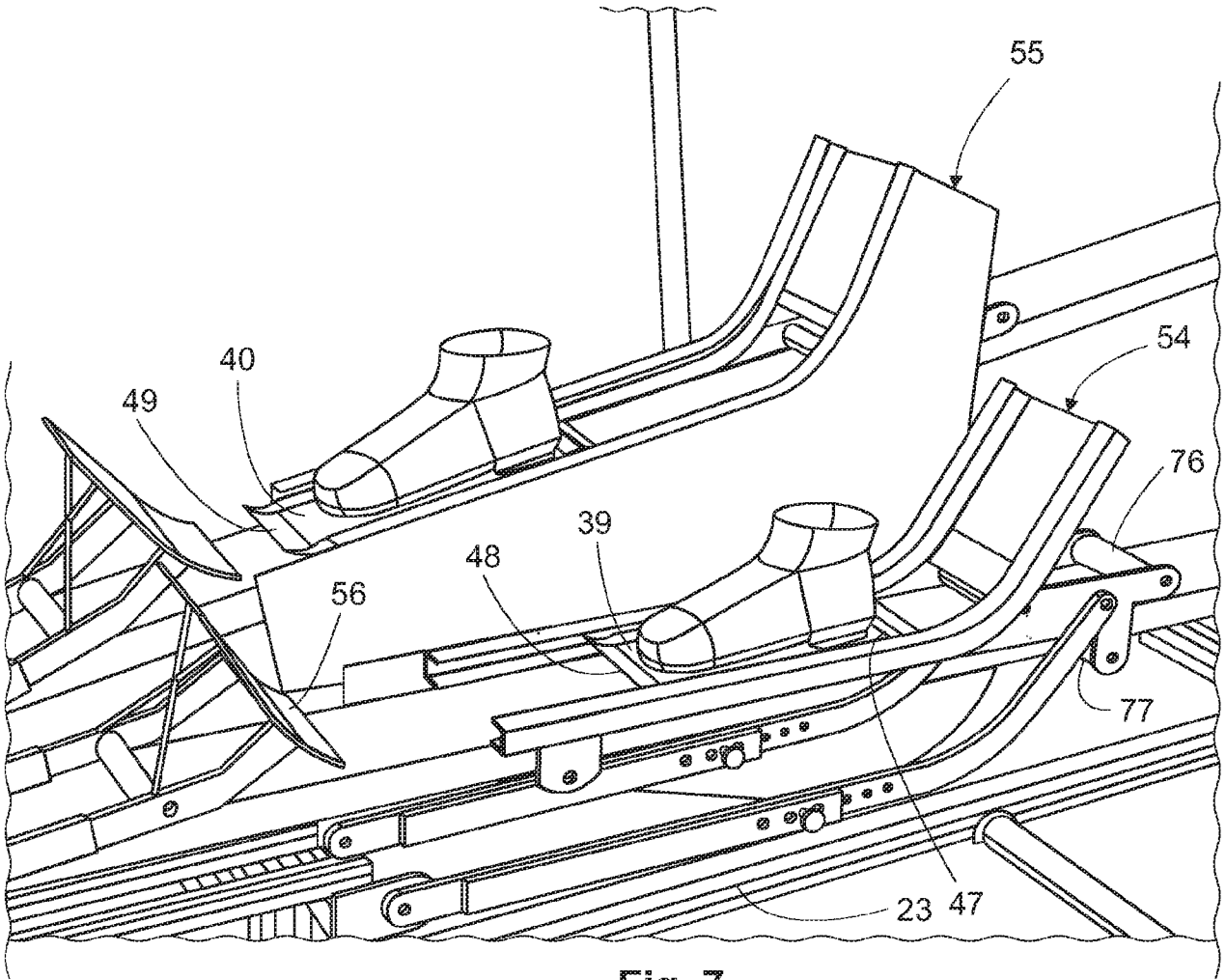
FIG. 7 is a detailed side perspective view of the apparatus, similar to FIG. 6.
Figure 8:
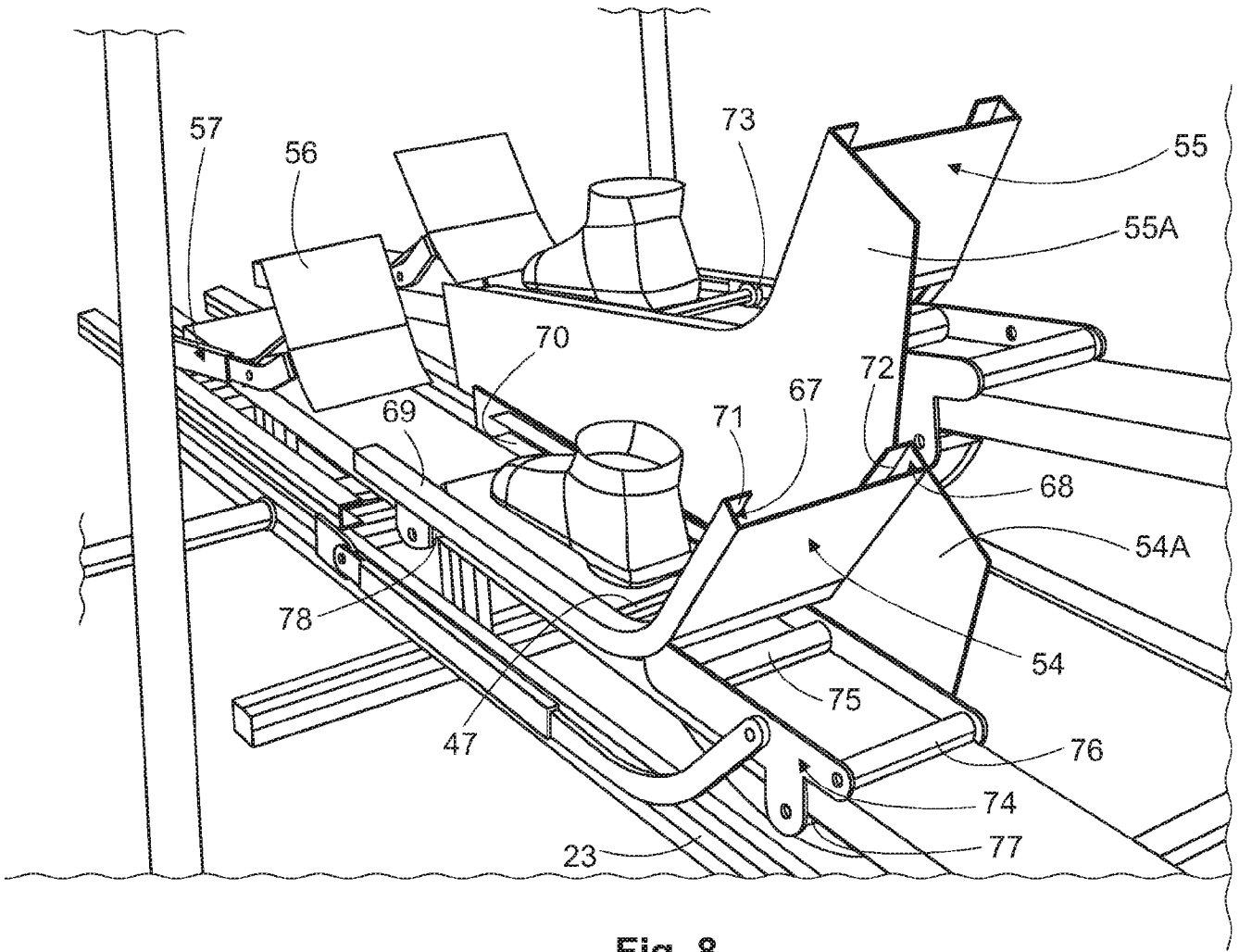
FIG. 8 is a detailed rear perspective view of the apparatus, showing the schematic feet of a patient during the sequence in the movement of the feet showing in FIGS. 6 and 7.

Guide plate 56 must accompany the up and down movement of walking bar 9 while permitting the back and forth movement of the walking bar. Thus, a transverse roller 64, see FIG. 6, is connected to arm lengths 62 of arms 57, 58 to roll onto walking bar 9 and a spring 65, 66, see FIGS. 5, 10, is connected to each arm 57, 58, preferably in arm length 62. Springs 65, 66 keep guide plate 56 under a resilient force urged against walking bar 9 and roller 64 keeps plate 56 in position relative to walking bar 9 to guarantee that curved edge 48, see FIG. 10, will always move onto plate 56 when reaching the plate in the forth movement of the walking bar.

As to the movement of the patient's feet at the rear part of the walking movement, reference will be made to the ear guide stops 54, 55, however, for clarity purposes only rear guide stop 54 for the left foot will be described in detail as long as the rear guide stop for the right side is identical. Rear guide stop 54 comprises two curved rear U-shaped guides, indicated by general references 67, 68, facing to each other by their open sides. Guides 67, 68 include respective horizontal guide lengths 69, 70, and curved and upwardly extending guide lengths 71, 72, see FIG. 8, 13. Associated with guides 67, 68, the rear edge of plate 44 is provided with guide follower ends, such as rollers at the end thereof, which rollers run into the guide lengths 69, 72 to cause the patient's foot move upwardly at the rear part of the walking movement as shown in FIGS. 12, 13 illustrating the left foot in that position. Since the guide follower ends, namely the rollers, of plate 44 do not appear in the drawings, reference is made to the rollers of plate 45, identical to the rollers of plate 44, with one of which being shown in FIGS. 8, 13 and indicated by reference 73.

To follow the walking movement of the walking bar, rear guide stop 54 is provided with a rear carriage 74 firmly affixed, by welding for example, to guide stop 54 and including upper rollers 75, 76 and a lower roller 77, at both upper and lower sides of walking bar 9, to keep guide stop 54 and walking bar together during the movement of the bar. In order to prevent the leading end of guide stop 54, and particularly the leading end of horizontal guide length 69, 70 move upwardly during the movement of the bar, guide lengths 69 79 are provided with a lower roller 78. Thus, rear guide stop 54 is pivotally connected to the walking bar, with the U-shaped guides being slidably resting onto the walking bar.

With the purpose of keeping the rear guide stop in place, to define the rear end of the walking step distance, guide stop 54, and more particularly carriage, is pivotally connected to respective rear ends of side arms 79, 80, see FIGS. 9, 10, which arms have respective leading ends pivotally connected at 81, only one is shown, at convenient parts of the chassis, such as a transverse beam 82. More particularly, arms 79, 80 are extensible arms comprised of arm lengths 83, 84, left arm, and 84, 86, right arm. To adjust the length of arms 79, 80 respective adjusting means may be provided. For example, a well know orifices and knob adjusting means 87, as generally indicated in FIGS. 9, 10, may be a good alternative. The rear end of arm length 83 will be pivotally connected to carriage 74 at 88.

While the leading guide stops 52, 53 and the rear guide stops 54, 55 have been illustrated and disclosed as being different of each other, it is important to remark that the leading and rear guide stops may be identical or the leading guide stop may be arranged at the place of the rear guide stop, and vice versa. For example, the leading guide stops may comprise, like the rear guide stops, a couple of facing "U" shaped guides, such as guides 67, 68, within which a pair of followers or rollers may run, such as rollers 73. Thus, the use of curved leading edges 48, 49 would not be necessary. Also, instead of curved edges 48, 49, upper foot plates 39, 40 may be provided with any kind of a leading sliding means or rolling cylinder that causes the plate move upwardly onto the guide stop.

It is clear form the above description that, when the patient's feet are retained at the foot retaining means 35, 36, the feet move together with the walking bars along the closed loop or step distance path, to copy the movement of a walking step. The stroke/run of the step is limited by the length of connecting rods 27, 28 with the front and rear guide stops 52-55 imposing the movements to the joints of the feet at the backward and forward ends of every step. Reference to the feet movements will be made only in connection to left foot as long as the same description is applied to the right food. When the foot reaches front or leading guide stop 52, the guide stop impels the instep (forefoot) upwards because the curved leading edge 48, with foot plate assembly 37 moving forth, enters into contact with plate 56 which causes upper plate 39 to move upwards and pivot around hinge 49, see FIG. 9. In like manner, when the foot reaches rear guide stop 54, rollers of plate 44, see as a reference rollers 73 of the right foot, are guided upwardly along guide length 71, 72 which causes foot plate assembly 37, namely plates 39, 44, move upwardly and pivoting together around hinge 46 pivotally fixed to walking bar. Thus, the rear guide stop pushes the heel upwards, thus triggering the movement in the symphysis of the foot during walking. To prevent any foot, that may get loose from the retaining means, from moving to a place between the walking bars and getting trapped under a scissor effect of the bar moving up and down, preferably rear guide stops 54, 55 are provided with side panels 54A and 55A, see FIG. 8, defining a protection for the feet. Alternatively, the apparatus is provided with a stationary panel affixed to the chassis and located in the gap between the walking bars.

Figure 14:
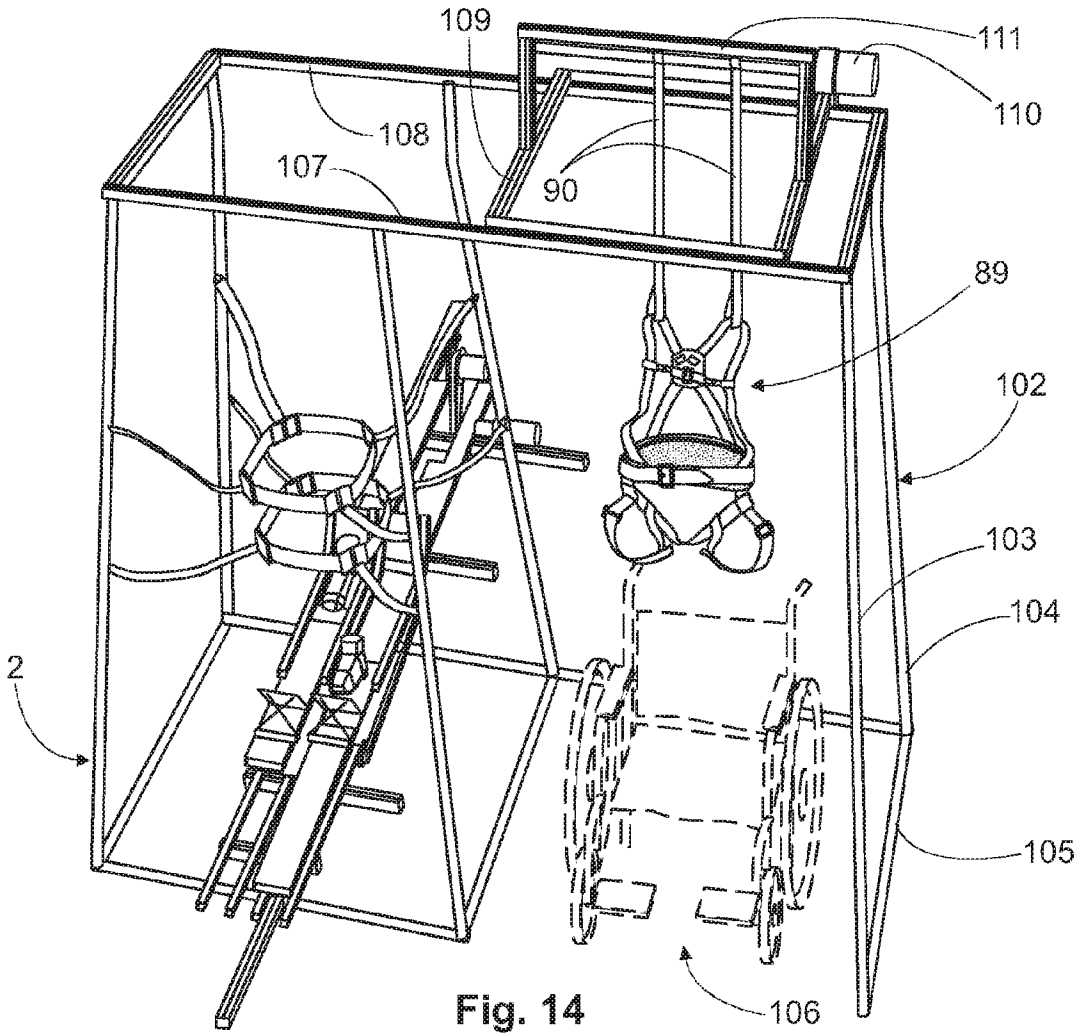
FIG. 14 is a top perspective view of the apparatus according to another embodiment of the invention, with to provide access to patients in wheelchairs, trolley or stretcher.

Considering that the patient is not in conditions to keep itself in a stand up position, the apparatus may be provided with patient's supporting means for supporting and keeping the patient in a desired position. These means may comprise parallel bars, if the patient is in conditions to keep his/her body sustained by the arms, or, preferably, may comprise a supporting harness, generally indicated at 89 only in FIG. 14 for clarity purposes, pending from the upper end of the apparatus and/or connected to columns 4-8. Harness 89 may be of any type capable of appropriately sustaining and supporting the patient and placing him in the desired position but preferably, the harness is connected to upper belts 90 to keep the patient sustained from the shoulders and torso belts to be affixed to the patient's torso, from the waist and/or groin and/or hips.

The harness is connected to harness motor means 92, which may comprise a crank handle, as illustrated or an electric motor capable of moving the harness up and down. Thus, the weight of the patient actuating on the patient's legs will be regulated as desired. According to this embodiment, upper belts 90 are connected to a rotating shaft 93, operated by the crank handle, to roll up the belts. A longitudinal and lateral adjustment of the patient position may be carried out by means of rear torso belts 94, 95 and leading torso belts 96, 97. By operating these belts the patient, depending of the disorder to be corrected, may be forced more or less to adopt a standing up, vertical position, or may be permitted to be slightly bent if the patients naturally walks with a stoop. Motor means 92 and shaft 93 also may move along guide bars 98, 99, by supports 100, 101, to further correct the position of the harness longitudinally.

Figure 15:
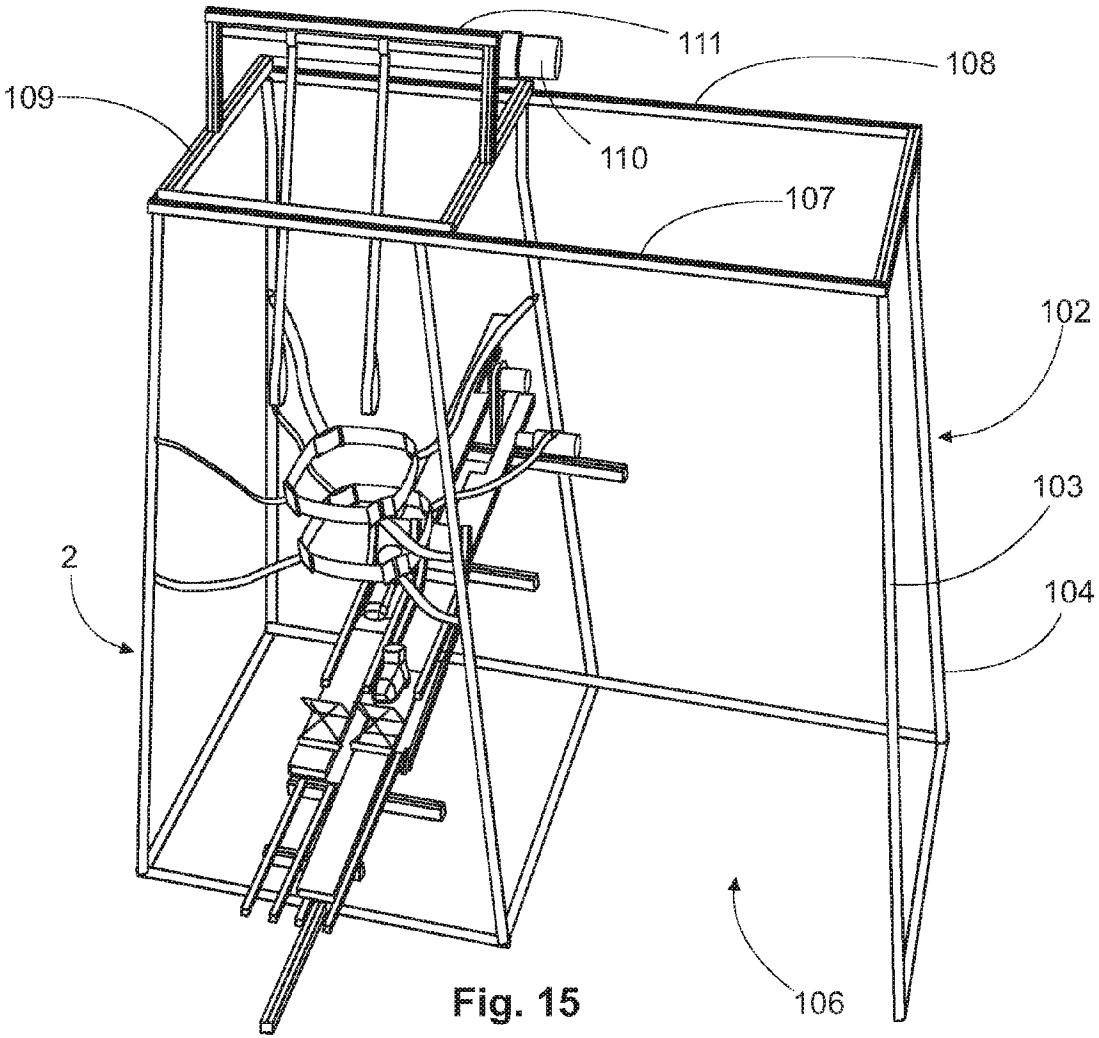
FIG. 15 is a top perspective view of the apparatus of FIG. 14.

According to another embodiment of the invention, the apparatus, in addition to chassis 2, has a side portion or side chassis 102 for receiving patients in wheel chairs. Side chassis 102 also is comprised of columns 103, 104 and a base 105 open to define an entrance 106 for a wheelchair, stretcher and the like. The upper end of the apparatus have a pair of guide beams 107, 108 and a frame 109 is capable of moving along the beams to be placed a position to receive a patient, shown in FIG. 14, and a position to support the patient during treatment, shown in FIG. 15. Harness motor means 110, such as an electrical motor, is mounted in frame 109 to actuate a rotary shaft 111, to move the harness up and down. Motor means 110 and shaft 111, move with frame 109 along the guide beams 107, 108 which thus define a motor guide for moving the harness motor means between the above described positions.

Figure 16:
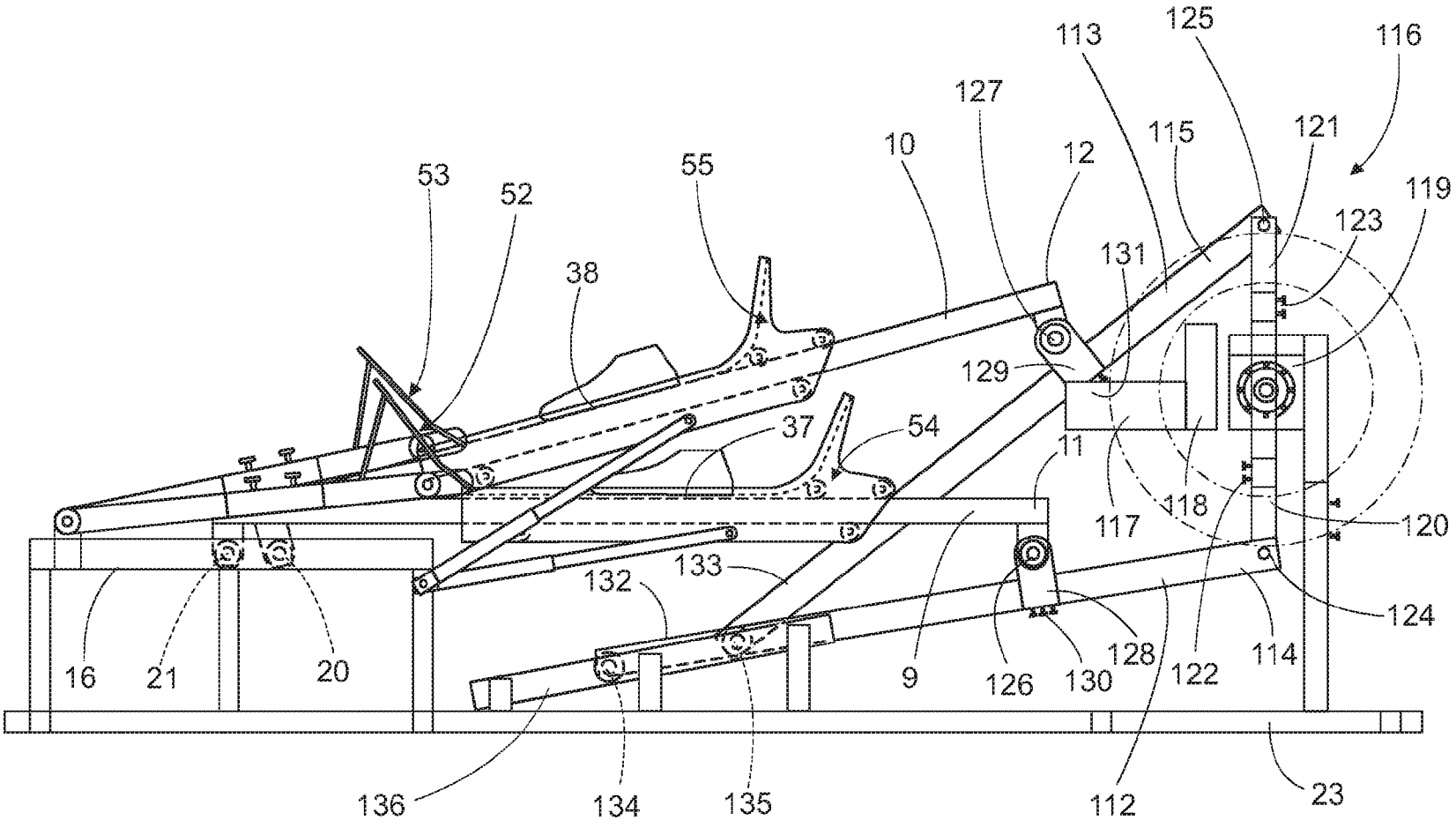
FIG. 16 is a side elevation view of the apparatus according to another embodiment of the invention.

In FIG. 16, an apparatus according to even another embodiment of the invention is shown, wherein all the apparatus components and parts that are common to those ones of the embodiment shown in FIGS. 1-15 have been indicated by the same reference number. Thus, the apparatus, preferably designed to support higher weights in a shorter design, is also comprised of a chassis with a base member 23 and with left walking bar 9 and left walking bar 10 with their respective leading ends having rollers 20, 21 running along guides 16, 17. The walking bars are also provided with the same front guide stops 52, 53 and rear guide stops 54, 55, as well as the foot plate assemblies 37, 38. Distinct from the above described embodiment, in the present one, rear ends 11, 12 of the walking bars are pivotally connected to respective a left intermediate walking bar 112 and a right intermediate walking bar 113, both moving up and down and back and forth along a closed movement loop.

Figure 4:
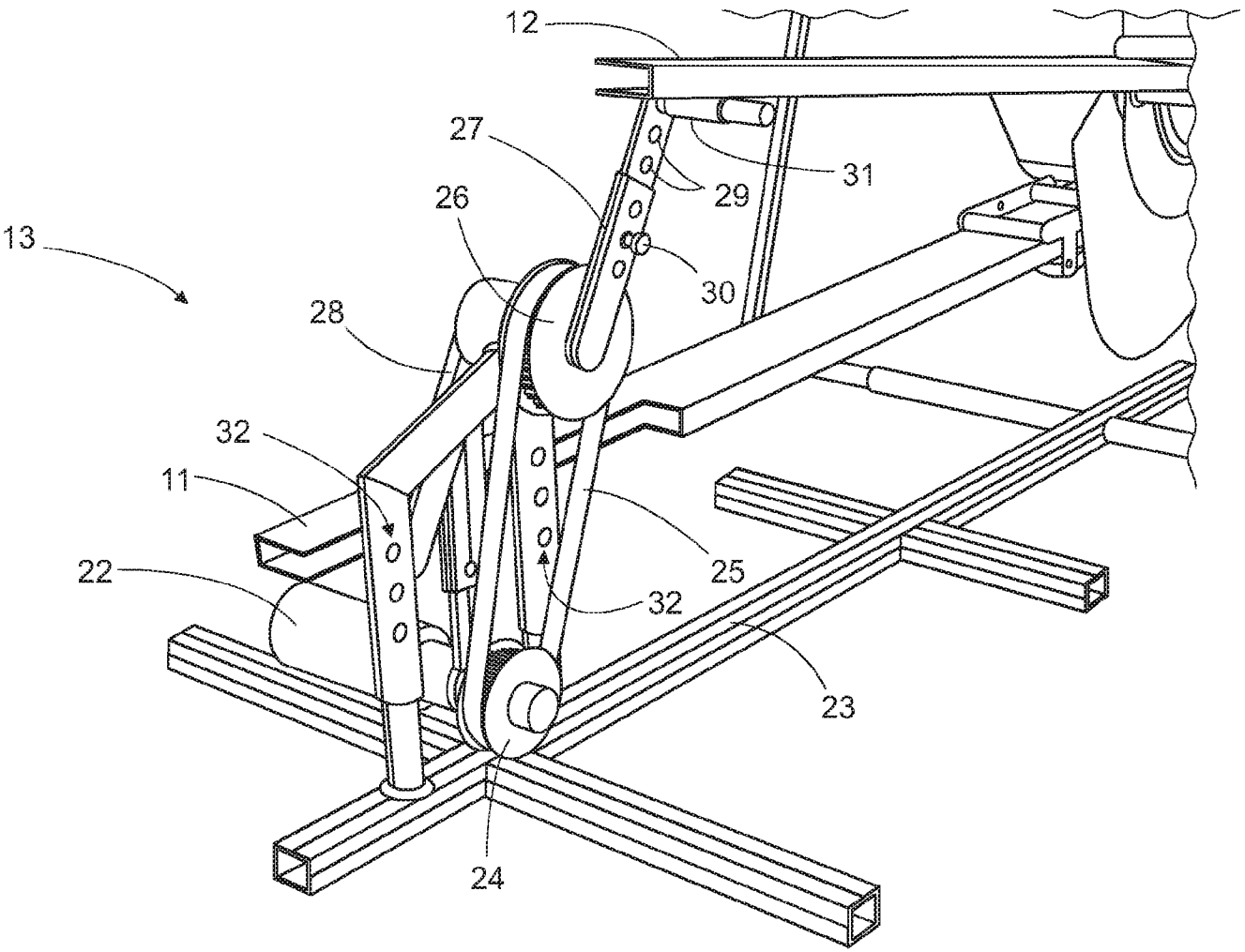
FIG. 4 is a detailed perspective view taken from the rear end of the apparatus to show the motor means for moving the walking bars.

Each intermediate walking bar 112, 113 has a respective rear end 114, 115 connected to motor means 116 that may be like the one shown in FIG. 4 or may comprise a motor 117 connected to a speed reducing gear box 118 to move a gear box 119 which in turn is connected to connecting rods 120, 121. Connecting rods 120, 121 are preferably extensible rods with length adjusting means 122, 123 of the type well known in the art. Connecting rods 120, 121 are pivotally connected at 124, 125 to rear ends 114, 115 of intermediate bars 112, 113.

The connection between walking bars 9, 10 to their respective intermediate walking bars 112, 113 is through pivoting connections 126, 127 including respective brackets 128, 129 provided with respective adjusting means 130, 131 to permit the movement of the brackets 128, 129 along intermediate bar 112, 113 to adjust the relative position between walking bars 9, 10 and intermediate walking bars 112, 113 with the result that the closed movement loop to copy a natural step movement is adapted to the patient biometric parameters. Finally, leading ends 132, 133 of intermediate bars 112, 113, respectively, are provided with rolling means, such as rollers 134, 135, shown in phantom lines in FIG. 16, running along and into respective front intermediate guide means, of which only one guide 136, for left intermediate walking bar 112, is shown.

The apparatus of the invention provides a range of services in treating patients suffering motor dysfunctions, neurological disorders, standing disorders and the like that is superlative as compared to other devices of the prior art. The new design and combination of components provides a wider range of movements and adjustments to different patients, also stimulating the standing equilibrium. No rods or complex retaining means are necessary to affix to the legs of the patient but only simple straps for example, are necessary to brace the patient's feet to firmly retain the same in the walking bars.

Since only the feet are affixed to the walking bars, the feet follow the movement of the bars along the closed loop copying the natural walking movement thus causing the feet, with all their joints, to move accordingly. Thus, the movement to the legs is imposed at the feet and not to the entire extension of the legs. As a result, the patient, after some treatment sessions, feels that he/she can move the legs to accompany the feet movement.

While preferred embodiments of the present invention have been illustrated and described, it will be obvious to those skilled in the art that various changes and modifications may be made therein without departing from the scope of the invention as defined in the appended claims.

I claim:

1. An apparatus for rehabilitation of patients with motor disorders, particularly patients suffering motor dysfunction in the legs, the apparatus comprising:

a left and right walking bars connected to motor means for moving up and down and back and forth along a closed movement loop;

a left and a right foot retaining means comprising a left and a right foot plate assemblies pivotally connected to the left and right walking bars respectively, for moving with the walking bars along a step distance path;

a patient's supporting means for supporting the patient;

fastening means in the left and right foot plate assemblies for retaining the feet of a patient during a treatment;

a front guide stop in each walking bar, at a front end of the step distance path, and a rear guide stop in each walking bar, at a rear end of the step distance path, to cause the foot plate assemblies move up and down in the ends of the step distance path;

wherein each foot plate assembly comprises a lower foot plate having a front edge hinged to the walking bar and a rear edge hinged to a rear edge of an upper foot plate, forming a rear hinged connection, the upper foot plate having a front curved edge to slidably move onto the front guide stop.

2. The apparatus of claim 1, wherein each walking bar has a rear end connected to said motor means and a front end slidably connected to front guide means.

3. The apparatus of claim 2, wherein the motor means comprise a crank and connecting rod mechanism.

4. The apparatus of claim 1, further comprising a chassis with the front guide means for the walking bars being fixed to a front end of the chassis, and with the motor means being mounted at a rear end of the chassis.

5. The apparatus of claim 1, further comprising a chassis wherein the front guide stop is pivotally connected to the chassis.

6. The apparatus of claim 1, wherein the rear edge of the lower foot plate has guide followers that are guided in the rear guide stop.

7. The apparatus of claim 5, wherein the front guide stop, in each walking bar, comprises a curved front guide stop plate slidably resting onto the walking bar.

8. The apparatus of claim 6, wherein the rear guide stop, in each walking bar, comprises two curved rear U-shaped guides facing to each other and pivotally connected to the walking bar, with the rear U-shaped guides being slidably resting onto the walking bar, and with the rear U-shaped guides receiving said guide followers.

9. The apparatus of claim 1, wherein the fastening means comprise ribbons fixed at the foot plate assemblies for embracing the feet of the patient.

10. The apparatus of claim 1, wherein the patient's supporting means comprises a supporting harness pending from a harness motor means, at an upper end of the apparatus, for moving the harness up and down.

11. The apparatus of claim 10, wherein the apparatus has a side portion for entering patients in a wheel or stretcher.

12. The apparatus of claim 11, wherein the upper end of the apparatus and the side portion have a motor guide for moving the harness motor means between a position for receiving a patient at a wheelchair or stretcher, and a position above the walking bars.

13. An apparatus for rehabilitation of patients with motor disorders, particularly patients suffering motor dysfunction in the legs, the apparatus comprising:

a left and right walking bars connected to motor means for moving up and down and back and forth along a closed movement loop;

a left and a right foot retaining means comprising a left and a right foot plate assemblies pivotally connected to the left and right walking bars respectively, for moving with the walking bars along a step distance path;

a patient's supporting means for supporting the patient;

wherein the left and right walking bars have respective rear ends pivotally connected to respective left and right intermediate walking bars moving up and down and back and forth along a closed movement loop;

fastening means in the left and right foot plate assemblies for retaining the feet of a patient during a treatment;

a front guide stop in each walking bar, at a front end of the step distance path, and a rear guide stop in each walking bar, at a rear end of the step distance path, to cause the foot plate assemblies move up and down in the ends of the step distance path, and wherein each foot plate assembly comprises a lower foot plate having a front edge hinged to the walking bar and a rear edge hinged to a rear edge of an upper foot plate, forming a rear hinged connection, the upper foot plate having a front curved edge to slidably move onto the front guide stop.

14. The apparatus of claim 13, wherein each intermediate walking bar has a rear end connected to motor means and a front end slidably connected to front intermediate guide means.

15. The apparatus of claim 13, wherein the front guide stop, in each walking bar, comprises a curved front guide stop plate slidably resting onto the walking bar and the rear guide stop, in each walking bar, comprises two curved rear U-shaped guides facing to each other and pivotally connected to the walking bar, with the U-shaped guides being slidably resting onto the walking bar.

16. The apparatus of claim 13, wherein the patient's supporting means comprises a supporting harness pending from a harness motor means, at an upper end of the apparatus, for moving the harness up and down.

17. An apparatus for rehabilitation of patients with motor disorders, particularly patients suffering motor dysfunction in the legs, the apparatus comprising:

a left and right walking bars connected to motor means for moving up and down and back and forth along a closed movement loop;

a left and a right foot retaining means comprising a left and a right foot plate assemblies pivotally connected to the left and right walking bars respectively, for moving with the walking bars along a step distance path;

a patient's supporting means for supporting the patient;

fastening means in the left and right foot plate assemblies for retaining the feet of a patient during a treatment;

a rear guide stop in each walking bar, at a rear end of the step distance path, to cause the foot plate assemblies move up and down in the rear end of the step distance path, and wherein each foot plate assembly comprises a lower foot plate having a front edge hinged to the walking bar and a rear edge hinged to a rear edge of an upper foot plate, forming a rear hinged connection, with the rear edge of the lower foot plate having guide followers that are guided in the rear guide stop.

18. The apparatus of claim 17, wherein each walking bar has a rear end connected to said motor means and a front end slidably connected to front guide means.

19. The apparatus of claim 17, wherein the rear guide stop, in each walking bar, comprises two curved rear U-shaped guides facing to each other and pivotally connected to the walking bar, with the rear U-shaped guides being slidably resting onto the walking bar, and with the rear U-shaped guides receiving said guide followers.

20. The apparatus of claim 17, wherein the patient's supporting means comprises a supporting harness pending from a harness motor means, at an upper end of the apparatus, for moving the harness up and down.

* * * * *